US010821477B2

(12) United States Patent
Dong et al.

(10) Patent No.: US 10,821,477 B2
(45) Date of Patent: Nov. 3, 2020

(54) COUPLED SYSTEM AND METHOD FOR THE SEPARATION AND DRYING OF MOIST FINE PARTICLE COAL

(71) Applicant: CHINA UNIVERSITY OF MINING AND TECHNOLOGY, XuZhou (CN)

(72) Inventors: Liang Dong, XuZhou (CN); Yuemin Zhao, XuZhou (CN); Chenlong Duan, XuZhou (CN); Junyu Lu, XuZhou (CN); Bo Zhang, XuZhou (CN)

(73) Assignee: China University of Mining and Technology, Xuzhou (CN)

( * ) Notice: Subject to any disclaimer, the term of this patent is extended or adjusted under 35 U.S.C. 154(b) by 0 days.

(21) Appl. No.: 15/767,538

(22) PCT Filed: Apr. 12, 2017

(86) PCT No.: PCT/CN2017/080269
§ 371 (c)(1),
(2) Date: Apr. 11, 2018

(87) PCT Pub. No.: WO2018/133220
PCT Pub. Date: Jul. 26, 2018

(65) Prior Publication Data

US 2020/0238337 A1 Jul. 30, 2020

(30) Foreign Application Priority Data

Jan. 21, 2017 (CN) ..... 2017 1 0043965

(51) Int. Cl.
*B07B 9/00* (2006.01)
*B07B 7/12* (2006.01)
(Continued)

(52) U.S. Cl.
CPC ..... *B07B 9/00* (2013.01); *B07B 7/12* (2013.01); *F26B 3/092* (2013.01); *F26B 21/00* (2013.01); *F26B 25/22* (2013.01)

(58) Field of Classification Search
CPC ... B07B 9/00; B07B 7/12; F26B 25/22; F26B 21/00; F26B 3/092
See application file for complete search history.

(56) References Cited

U.S. PATENT DOCUMENTS 5,283,959 A * 2/1994 Nagayoshi ..... F26B 3/084 34/591
5,373,648 A * 12/1994 Wolf ..... F26B 3/08 165/104.16
(Continued)

FOREIGN PATENT DOCUMENTS

CN 103196281 A 7/2013
CN 103773544 A 5/2014
(Continued)

*Primary Examiner* — Patrick H Mackey
(74) *Attorney, Agent, or Firm* — Greenberg Traurig, LLP

(57) ABSTRACT

A system for separation and drying of moist fine particle coal includes a blast blower, a surge tank, a moisture detection sensor, a control device and two pipelines, wherein the blast blower is communicated with the surge tank; one end of two pipelines which are connected in parallel is communicated with the surge tank, while the other end is communicated with a fluidized bed; a first pipeline includes a first valve, a first flowmeter, an air heater and an electric butterfly valve which are connected in series sequentially, while the second pipeline includes a second valve and a second flowmeter which are connected in series; the moisture detection sensor is arranged in the fluidized bed; and the control device is connected with the blast blower, the first valve, the first flowmeter, the air heater, the second valve, the second flowmeter and the moisture detection sensor.

5 Claims, 1 Drawing Sheet

(51) Int. Cl.

| | |
|---|---|
| ***F26B 3/092*** | (2006.01) |
| ***F26B 21/00*** | (2006.01) |
| ***F26B 25/22*** | (2006.01) |

(56) References Cited

U.S. PATENT DOCUMENTS

| | | | | |
|---|---|---|---|---|
| 7,540,384 | B2 * | 6/2009 | Ness | B03B 4/06 209/133 |
| 8,505,735 | B2 * | 8/2013 | Han | B03C 1/0335 209/223.1 |
| 8,661,821 | B2 * | 3/2014 | Zhao | F01K 7/22 122/4 R |
| 9,126,134 | B2 * | 9/2015 | Zhao | B01D 47/05 |
| 9,506,691 | B2 * | 11/2016 | Orr | F26B 3/084 |
| 9,964,357 | B2 * | 5/2018 | Zhao | F26B 3/0923 |
| 10,316,392 | B2 * | 6/2019 | Qi | C22B 34/22 |
| 2011/0036758 | A1 * | 2/2011 | Kim | B03C 3/30 209/4 |
| 2011/0214427 | A1 * | 9/2011 | Zhao | F01K 17/06 60/653 |
| 2016/0054056 | A1 | 2/2016 | Zhao et al. | |
| 2016/0369194 | A1 * | 12/2016 | Duan | C10L 5/04 |

FOREIGN PATENT DOCUMENTS

| | | | | |
|---|---|---|---|---|
| CN | 104479788 | A | 4/2015 | |
| WO | 2008138818 | A1 | 11/2008 | |
| WO | 2010019246 | A2 | 2/2010 | |
| WO | WO-2017000883 | A1 * | 1/2017 | F26B 25/00 |

* cited by examiner

COUPLED SYSTEM AND METHOD FOR THE SEPARATION AND DRYING OF MOIST FINE PARTICLE COAL

CROSS REFERENCE TO RELATED APPLICATIONS

The present application is a 371 U.S. National Stage of International Application No. PCT/CN2017/080269, filed Apr. 12, 2016, entitled "Coupled System and Method for the Separation and Drying of Moist Fine Particle Coal" which in turn claims priority to Chinese Application 201710043965.2 with the same title filed Jan. 21, 2017, both of which are incorporated herein by reference in their entirety.

FIELD OF THE DISCLOSURE

The present invention relates to a processing system and a method for moist fine particle coal, in particular to a coupled system and a method for the separation and drying of moist fine particle coal.

BACKGROUND OF RELATED ART

In China, coal resource reserves are rich, however, the degree of mining, processing and utilization is low. The characteristics of high moisture and high ash content of brown coal determines that prior to use, brown coal must be upgraded by the dehydration and de-ashing processes; and the characteristic of easiness in mudding in water of brown coal determines that the traditional technology of coal dressing using wet method is not applicable to the de-ashing process of brown coal. The conventional brown coal dehydration upgrading technology only achieves the removal of partial moisture from the brown coal, but cannot achieve the effect of coal separation. According to the Chinese Invention Patent with the patent number 201410024794.5, the process of carrying out drying and separation of brown coal via the pulsating air flow can achieve the dehydration and separation effect of brown coal. The operating process is divided into the drying area and the separation area; in the drying area, the air flow volume is large, while in the separation area, the air flow volume is small, hence, the interaction effect of particle movement between the drying area and the separation area leads to reduction in the separation efficiency. In addition, in such way, the drying stage and the separation stage cannot be automatically switched depending on the moisture content of coal particles, i.e., in the existing way, drying time cannot be controlled, resulting in failure of accurate control of the moisture of the dried product; and in the separation stage, owing to the pulsating air flow, the separation effect is also changed under bed density in the periodic opening and closing processes of air flow.

CONTENT OF THE INVENTION

Aiming at the problems existing in the prior art, the present invention provides a coupled system and a method for the separation and drying of moist fine particle coal. The coupled system can sequentially achieve drying and separation of brown coal particles in the fluidized bed, making the upgrading separation of brown coal particles by dehydration and de-ashing done within one process flow, thereby improving the working efficiency and simplifying the process flow.

In order to fulfill the above-mentioned purpose, the technical solution of the invention is that a coupled system for the separation and drying of moist fine particle coal comprises a blast blower, a surge tank, a moisture detection sensor, a control device and two pipelines, wherein the blast blower is communicated with the surge tank; one end of two pipelines which are connected in parallel is communicated with the surge tank, while the other end is communicated with a fluidized bed; one of the two pipelines consists of a No. 1 valve, a No. 1 flowmeter, an air heater and an electric butterfly valve which are connected in series sequentially, while the other pipeline consists of a No. 2 valve and a No. 2 flowmeter which are connected in series; the moisture detection sensor is arranged in the fluidized bed; and the control device is respectively connected with the blast blower, the No. 1 valve, the No. 1 flowmeter, the air heater, the No. 2 valve, the No. 2 flowmeter, the electric butterfly valve and the moisture detection sensor.

Further, the air heater is an electrical heating type.

A coupled method for the separation and drying of moist fine particle coal comprises the following steps:

(1) The mined brown coal particles are put into the fluidized bed, and the moisture detection sensor detects the moisture content on the surfaces of the brown coal particles in the fluidized bed in real time and transmits it back to the control device;

(2) the control device compares the detected moisture content with the set moisture content, if it exceeds the set moisture content, the control device will control the air heater and the blast blower to open, and at the same time, control the No. 1 valve and the electric butterfly valve to open, so that air flow generated by the blast blower flows through the surge tank for pressure stabilizing, and then, the air flow is heated into hot air flow by the air heater after passing through the No. 1 valve and the No. 1 flowmeter; after the hot air flow passes through the electric butterfly valve, pulsating hot air flow is generated and is conveyed to the fluidized bed for the drying of brown coal particles; and the No. 1 flowmeter feedback the real-time flow value to the control device, and the control device controls the fluidization number by controlling the opening degree of the No. 1 valve based on the set flow value;

(3) in the drying process, the moisture detection sensor detects the moisture content on the surfaces of the brown coal particles in the fluidized bed in real time, and if the detected moisture content is reduced to the set moisture content, the drying process will be completed;

(4) during the process of separation and de-ashing, the control device controls the air heater to stop operating, and at the same time, controls the fluidization number of the pulsating air flow by controlling the aperture opening degree of the No. 1 valve; in addition, the control device controls the No. 2 valve to open, and controls the fluidization number by controlling the aperture opening degree of the No. 2 valve via the flow value detected by the No. 2 flowmeter in real time; air flow generated by the blast blower is divided into two paths after being subjected to pressure stabilizing by the surge tank, in one path, the pulsating air flow is generated via the No. 1 valve, the No. 1 flowmeter and the electric butterfly valve to be inputted to the fluidized bed, and in the other path, continuous air flow is generated by the No. 2 valve and the No. 2 flowmeter to enter the fluidized bed for the separation of brown coal particles;

(5) under the combined action of the pulsating air flow and the continuous air flow, brown coal particles are layered in accordance with the density in the fluidized bed to complete the separation and de-ashing process of brown coal particles; wherein the input of the continuous air flow can maintain the bed of fluidized bed having a certain expansion rate; and the pulsating air flow can introduce vibrating energy to reduce bubble size in the bed, enhance the uniform stability of bed density and enhance the layered separation of coal particles as per density, thereby achieving the separation and de-ashing process of brown coal particles under the combination of both air flows.

Further, in the drying process, the temperature of the hot air flow is 90 to 200 degree Celsius, air flow frequency is 0.5 to 8 Hz, and the fluidization number is 1.6 to 2.2.

Further, in the separation process, the fluidization number of the continuous air flow is 0.6 to 1.0, the fluidization number of the pulsating air flow is 0.2 to 0.6, and the frequency is 0.5 to 8 Hz.

Further, in the separation process, the temperature of the continuous air flow and the pulsating air flow is normal temperature.

Further, the set moisture content on the surfaces of brown coal particles is 4%.

According to the invention, in the brown coal particle drying stage, the advantage of high heat transfer efficiency of the pulsating air flow is fully utilized. According to different requirements of fluidization air speed and temperature during the dehydration and separation of brown coal particles, the method comprises two operating stages: in the drying stage, the pulsating hot air flow is introduced using a pulsating hot-air system, the temperature and flow velocity of air flow are high, and the advantage of high heat transfer efficiency in pulsating fluidization state is fully used, thereby achieving the drying of brown coal particles. Separation under the combination of the continuous air flow and the pulsating air flow has the advantages that (1) the forced vibrating energy of the pulsating air flow can reduce the sizes of bubbles in the concentrated phase bubbling fluidized bed, enhance the uniform stability of the bed density in three-dimensional space and strengthen the process of layering brown coal particles as per density; and (2) on the basis of the pulsating air flow, the continuous air flow is introduced with the changing range of continuous air flow of 0.6 to 1.0, by which the brown coal particle layers in the fluidized bed have a certain expansion rate within the period of time at which the pulsating air flow is closed, thereby reducing the change in the bed density in the periodic opening and closing processes of air flow and enhancing the layering of particles as per density. In addition, according to different moisture of fed brown coal, the operating mode is switched automatically to regulate the flow, temperature and pulsating frequency of air flow, thereby achieving the optimal drying and separation effects. Finally, the integration of the dehydration and separation of brown coal with high moisture rate and ash content is achieved, thereby simplifying the process flow.

Compared with the prior art, the invention has the advantages in that (1) in the drying process, the pulsating air flow is used, and in the separation process, the pulsating air flow and the continuous air flow are combined to use; (2) the system of the present invention is in the drying state or the separation state, which is completed automatically by the control system, and after the moisture on the surfaces of particles is smaller than the set value, the system will be in the separation state, which can ensure the moisture on the surfaces of the dried coal particles meets the requirement; and (3) the drying and separation of the present invention are completed in the same area in the fluidized bed, the drying or separation operating state is automatically completed by the controller, and the drying process and the separation process are not interfered with each other, thereby ensuring both the drying effect and the separation efficiency.

DETAILED DESCRIPTION

Hereunder the present invention will be further detailed.

Figure 1:
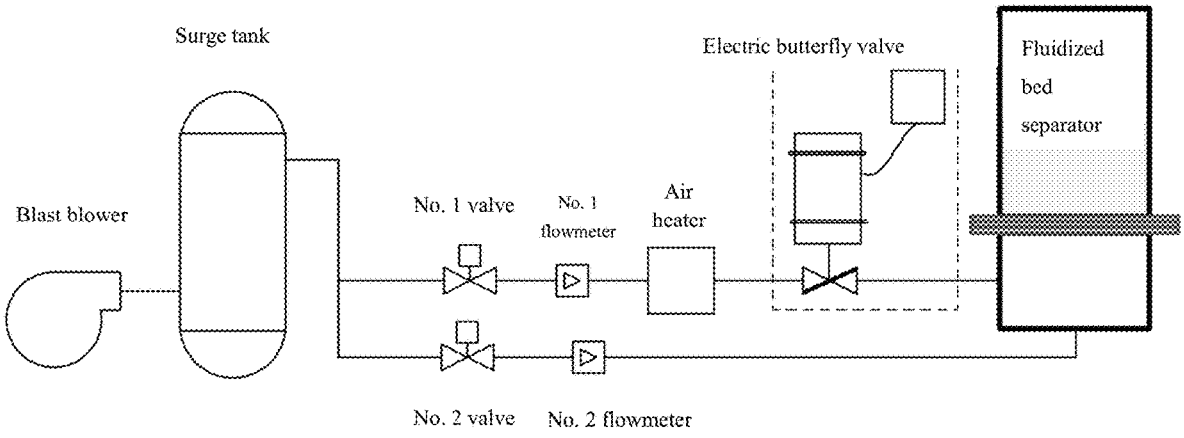
FIG. 1 is the flow schematic diagram of the system in the invention.
Figure 2:
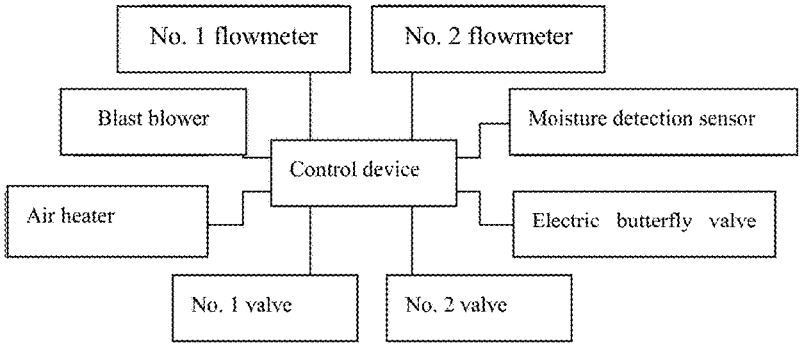
FIG. 2 is an electronics functional block diagram of the invention.

As shown in the FIGS. 1 and 2, a coupled system for the separation and drying of moist fine particle coal, which comprises a blast blower, a surge tank, a moisture detection sensor, a control device and two pipelines, wherein the blast blower is communicated with the surge tank; one end of two pipelines which are connected in parallel is communicated with the surge tank, while the other end is communicated with a fluidized bed; one of the two pipelines consists of a No. 1 valve, a No. 1 flowmeter, an air heater and an electric butterfly valve which are connected in series sequentially, while the other pipeline consists of a No. 2 valve and a No. 2 flowmeter which are connected in series; the moisture detection sensor is arranged in the fluidized bed; and the control device is respectively connected with the blast blower, the No. 1 valve, the No. 1 flowmeter, the air heater, the No. 2 valve, the No. 2 flowmeter, the electric butterfly valve and the moisture detection sensor.

Further, the air heater is an electrical heating type.

A coupled method for the separation and drying of moist fine particle coal comprises the following steps:

(1) the mined brown coal particles are put into the fluidized bed, and the moisture detection sensor detects the moisture content on the surfaces of the brown coal particles in the fluidized bed in real time and transmits it back to the control device;

(2) the control device compares the detected moisture content with the set moisture content, if it exceeds the set moisture content, the control device will control the air heater and the blast blower to open, and at the same time, control the No. 1 valve and the electric butterfly valve to open, so that air flow generated by the blast blower flows through the surge tank for pressure stabilizing, and then, the air flow is heated into hot air flow by the air heater after passing through the No. 1 valve and the No. 1 flowmeter; after the hot air flow passes through the electric butterfly valve, pulsating hot air flow is generated and is conveyed to the fluidized bed for the drying of brown coal particles; and the No. 1 flowmeter feedbacks the real-time flow value to the control device, and the control device controls the fluidization number by controlling the opening degree of the No. 1 valve based on the set flow value;

(3) in the drying process, the moisture detection sensor detects the moisture content on the surfaces of the brown coal particles in the fluidized bed in real time, and if the detected moisture content is reduced to the set moisture content, the drying process will be completed;

(4) during the process of separation and de-ashing, the control device controls the air heater to stop operating, and at the same time, controls the fluidization number of the pulsating air flow by controlling the aperture opening degree of the No. 1 valve; in addition, the control device controls the No. 2 valve to open, and controls the fluidization number by controlling the aperture opening degree of the No. 2 valve via the flow value detected by the No. 2 flowmeter in real time; air flow generated by the blast blower is divided into two paths after being subjected to pressure stabilizing by the surge tank, in one path, the pulsating air flow is generated via the No. 1 valve, the No. 1 flowmeter and the electric butterfly valve to be inputted to the fluidized bed, and in the other path, continuous air flow is generated by the No. 2 valve and the No. 2 flowmeter to enter the fluidized bed for the separation of brown coal particles;

(5) under the combined action of the pulsating air flow and the continuous air flow, brown coal particles are layered in accordance with the density in the fluidized bed to complete the separation and de-ashing process of brown coal particles, wherein the input of the continuous air flow can maintain the bed of fluidized bed having a certain expansion rate; and the pulsating air flow can introduce vibrating energy to reduce bubble size in the bed, enhance the uniform stability of bed density and enhance the layered separation of coal particles as per density, thereby achieving the separation and de-ashing process of brown coal particles under the combination of both air flows.

Further, in the drying process, the temperature of the hot air flow is 90 to 200 degree Celsius, air flow frequency is 0.5 to 8 Hz, and the fluidization number is 1.6 to 2.2.

Further, in the separation process, the fluidization number of the continuous air flow is 0.6 to 1.0, the fluidization number of the pulsating air flow is 0.2 to 0.6, and the frequency is 0.5 to 8 Hz.

Further, in the separation process, the temperature of the continuous air flow and the pulsating air flow is normal temperature.

Further, the set moisture content on the surfaces of brown coal particles is 4%.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

We claim:

1. A method for a coupled system of separation and drying of moist fine particle coal wherein the system comprises:

at least two pipelines, wherein the first of the at least two pipelines consists of a No. 1 valve, a No. 1 flowmeter, an air heater and an electric butterfly valve which are connected in series sequentially, and the second of the at least two pipelines consists of a No. 2 valve and a No. 2 flowmeter which are connected in series;

a blast blower communicated with a surge tank, wherein one end of each of the at least two pipelines is communicated with the surge tank and connected in parallel to the other of the at least two pipelines, while the other end of each of the at least two pipelines is communicated with a fluidized bed;

a moisture detection sensor arranged in the fluidized bed; and a control device that is respectively connected with the blast blower, the No. 1 valve, the No. 1 flowmeter, the air heater, the No. 2 valve, the No. 2 flowmeter, the electric butterfly valve and the moisture detection sensor; wherein, the air heater is an electrical heating type;

the method comprising the following steps:

putting mined brown coal particles into the fluidized bed;

detecting a moisture content on the surfaces of the brown coal particles in the fluidized bed in real time by the moisture detection sensor;

transmitting the moisture content back to the control device;

comparing a detected moisture content with a set moisture content with the control device, wherein if the detected moisture content exceeds the set moisture content, the control device will control the air heater and the blast blower to open, and at the same time, control the No. 1 valve and the electric butterfly valve to open, so that an air flow generated by the blast blower flows through the surge tank for pressure stabilizing, and then, the air flow is heated into a hot air flow by the air heater after passing through the No. 1 valve and the No. 1 flowmeter;

generating the hot air flow pulsatingly after the hot air flow passes through the electric butterfly valve;

conveying the hot air flow to the fluidized bed to dry the brown coal particles;

providing real-time flow value feedback to the control device of the No. 1 flowmeter;

controlling the fluidization number by controlling the opening degree of the No. 1 valve based on the set flow value with the control device;

detecting the moisture content during the drying process on the surfaces of the brown coal particles in the fluidized bed in real time using the moisture detection sensor, if the detected moisture content is reduced to the set moisture content, the drying process will be completed;

directing the air heater to stop operating during the process of separation and de-ashing via the control device while at the same time controlling the fluidization number of the pulsating air flow by controlling an aperture opening degree of the No. 1 valve;

controlling the No. 2 valve to open via the control device and controlling the fluidization number with an aperture opening degree of the No. 2 valve via the flow value detected by the No. 2 flowmeter in real time;

generating a second air flow by the blast blower that is divided into two paths after being subjected to pressure stabilizing by the surge tank, in one path, the pulsating air flow is generated via the No. 1 valve, the No. 1 flowmeter and the electric butterfly valve to be inputted to the fluidized bed, and in the other path, continuous air flow is generated by the No. 2 valve and the No. 2 flowmeter to enter the fluidized bed for the separation of the brown coal particles; and layering the brown coal particles in accordance with the density in the fluidized bed under a combined action of the pulsating air flow and the continuous air flow to complete the separation and de-ashing process of the brown coal particles.

2. The coupled method for the separation and drying of moist fine particle coal according to claim 1, wherein, in the drying process, the temperature of the hot air flow is 90 to 200 degree Celsius, air flow frequency is 0.5 to 8 Hz, and the fluidization number is 1.6 to 2.2.

3. The coupled method for the separation and drying of moist fine particle coal according to claim 1, wherein, in the separation process, the fluidization number of the continuous air flow is 0.6 to 1.0, the fluidization number of the pulsating air flow is 0.2 to 0.6, and the frequency is 0.5 to 8 Hz.

4. The coupled method for the separation and drying of moist fine particle coal according to claim 1, wherein, in the separation process, the temperature of the continuous air flow and the pulsating air flow is normal temperature.

5. The coupled method for the separation and drying of moist fine particle coal according to claim 1, wherein, the set moisture content on the surfaces of brown coal particles is 4%.

* * * * *